US006059103A

United States Patent [19]

Izen et al.

[11] Patent Number: 6,059,103

[45] Date of Patent: May 9, 2000

[54] RETAIL PACKAGING FOR MUSICAL INSTRUMENT

[75] Inventors: Mark Izen, Chestnut Hill; Brian Connolly, Braintree, both of Mass.

[73] Assignee: First Act, Inc., Needham, Mass.

[21] Appl. No.: 09/211,562

[22] Filed: Dec. 15, 1998

[51] Int. Cl.[7] ..... A45C 11/00

[52] U.S. Cl. ..... 206/314; 206/485; 206/733; 206/780

[58] Field of Search ..... 206/314, 733, 206/521, 592, 525.1, 784, 775, 780, 779, 426, 446, 481, 485; 84/411 R, 420, 421, 431, 453

[56] References Cited

U.S. PATENT DOCUMENTS

| | | | |
|---|---|---|---|
| 2,690,290 | 9/1954 | Turner | 206/485 |
| 3,631,970 | 1/1972 | Trauschke | 206/779 |
| 3,741,462 | 6/1973 | Flint et al. . | |
| 3,835,986 | 9/1974 | Le Beau | 206/446 |
| 4,046,251 | 9/1977 | Bruml . | |
| 4,171,050 | 10/1979 | Murray et al. . | |
| 4,200,188 | 4/1980 | Webinger . | |
| 4,201,294 | 5/1980 | Roccaforte . | |
| 4,352,480 | 10/1982 | Gathright | 206/314 |
| 4,474,290 | 10/1984 | DeMato | 206/314 |
| 4,572,362 | 2/1986 | Kronfeld | 206/775 |
| 5,156,276 | 10/1992 | Lebowitz . | |
| 5,772,032 | 6/1998 | Goldman . | |

FOREIGN PATENT DOCUMENTS

| | | | |
|---|---|---|---|
| 631094 | 8/1963 | Belgium | 206/485 |
| 676012 | 12/1963 | Canada | 206/485 |

OTHER PUBLICATIONS

Photograph of packaging in which Mark II Bongos, Model #MBS–22 have been marketed by Universal Music, Inc.

*Primary Examiner*—Ted Kavanaugh
*Assistant Examiner*—Luan K. Bui
*Attorney, Agent, or Firm*—Bromberg & Sunstein LLP

[57] ABSTRACT

A display package for point-of-purchase display of an article such as a musical instrument having a percussion surface and a sounding aperture. The package has a top panel and a bottom panel, each of the top and bottom panels having openings, one for allowing consumer access to the percussion surface and the second for permitting emission of sound from the sounding aperture of the instrument. A collar shelf is coupled to the rear panel and disposed in a plane substantially parallel to the top panel for preventing motion of the instrument in any direction having a component tangential to the top panel.

5 Claims, 3 Drawing Sheets

RETAIL PACKAGING FOR MUSICAL INSTRUMENT

TECHNICAL FIELD

The present invention relates to a display package for an article to which consumer access is desirable and more particularly for a musical instrument.

BACKGROUND OF THE INVENTION

Retail packaging is known which provides some access, on the store shelf, to consumer products. In some cases the access is visual, and in some cases it is possible for the consumer to actually feel the product.

Prior art retail packaging that has allowed a product to be sounded through the packaging has been used for the marketing of bongo drums, retaining the instrument with respect to motion in three orthogonal directions directly by the ends of the packaging. Packaging known in the art is inadequate for retaining and safely shipping instruments of larger dimensions where access of the palm of the hand of the consumer to a surface of the instrument is desired and where a second aperture is required to allow a full sound to emanate from the instrument.

SUMMARY OF THE INVENTION

In accordance with a preferred embodiment of the present invention, there is provided a package for point-of-purchase display of a musical instrument having a percussion surface and a sounding aperture. The package has a top panel and a bottom panel, each of the top and bottom panels being coupled to a rear panel. The top and bottom panels are substantially parallel and engage opposite ends of the musical instrument for preventing motion of the instrument in a direction perpendicular to the top and bottom panels. The package also has a first opening in the top panel for consumer access to the percussion surface and a second opening in the bottom panel for permitting emission of sound from the sounding aperture of the instrument. A collar shelf is coupled to the rear panel and disposed in a plane substantially parallel to the top panel for preventing motion of the instrument in any direction having a component tangential to the top panel.

In accordance with a further embodiment of the present invention, the package also has a side panel for bracing at least one of the top panel, the bottom panel, and the collar shelf with respect to the rear panel.

BRIEF DESCRIPTION OF THE DRAWINGS

The invention will be more readily understood by reference to the following description, taken with the accompanying drawings, in which.

DETAILED DESCRIPTION OF SPECIFIC EMBODIMENTS

Figure 1:
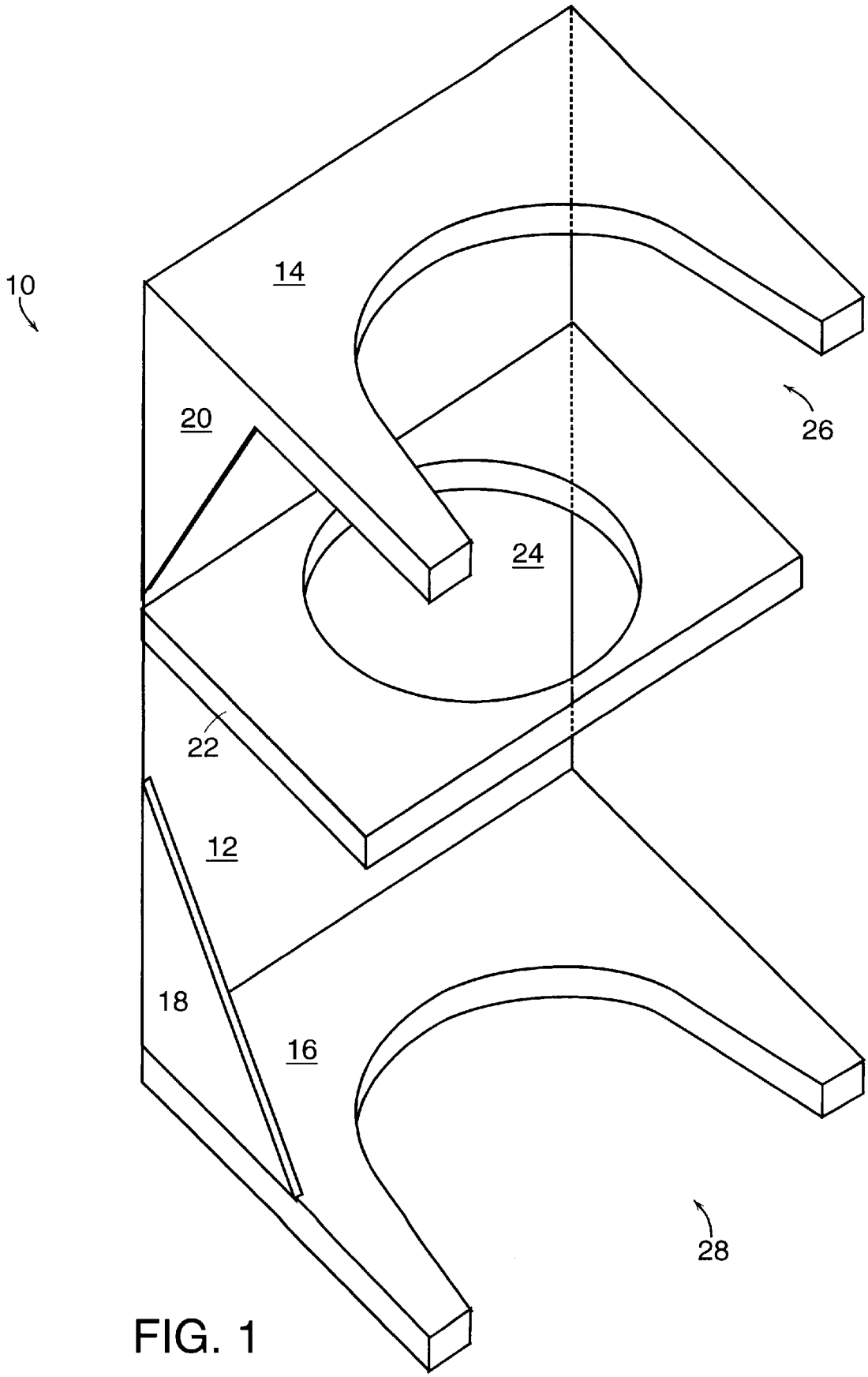
FIG. 1 is a perspective view of a display package, in accordance with a preferred embodiment of the present invention.
Figure 2:
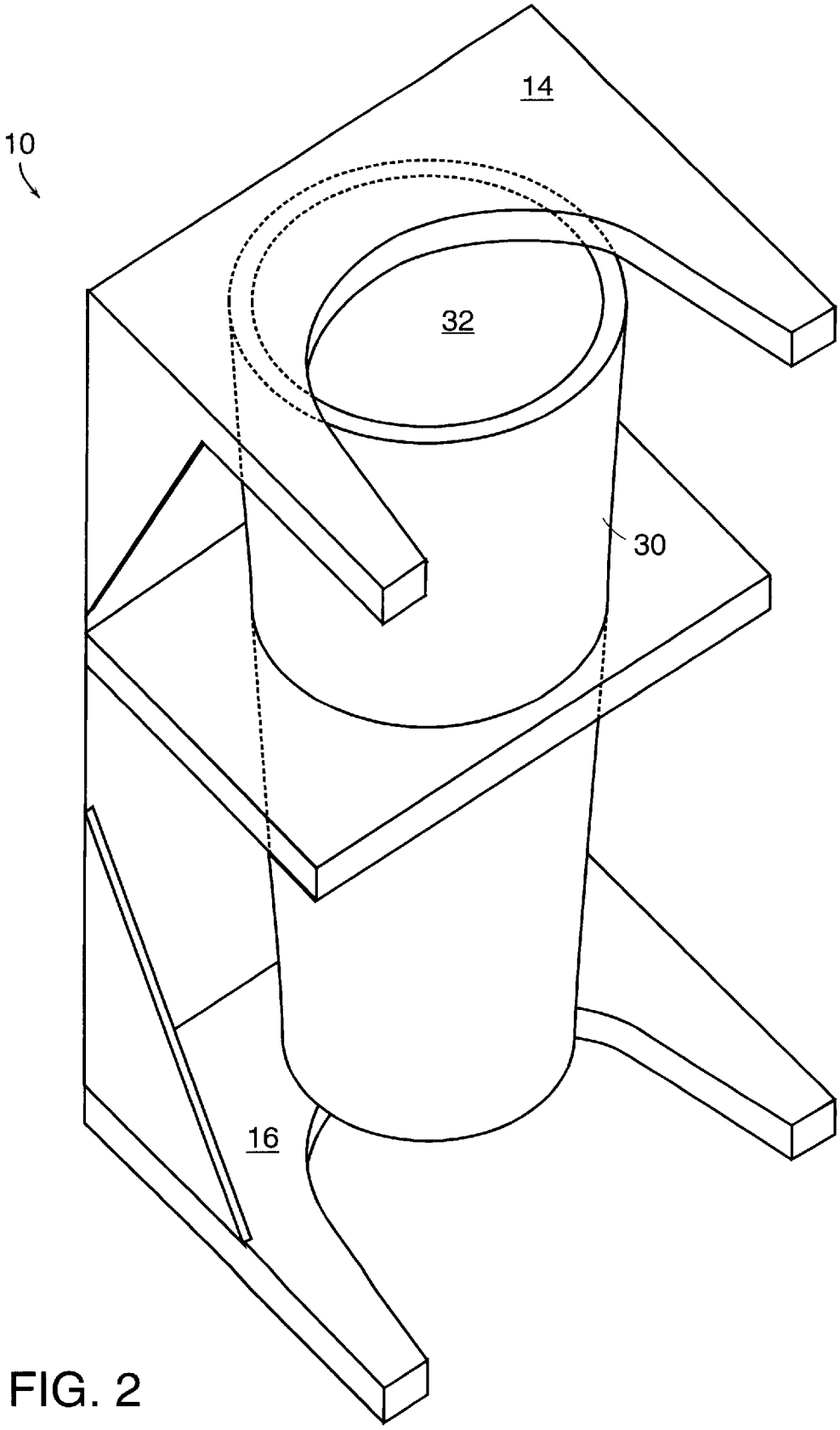
FIG. 2 is a perspective view of the display package of FIG. 1, showing a drum displayed in the package, by way of example.

In accordance with preferred embodiments of the present invention, a display package is provided that allows consumer access to a musical instrument while additionally providing a portal for the emanation of sound. Referring to FIG. 1, display package 10, after complete folding and assembly, is a three-dimensional structure that retains a product (not shown) to which consumer access at the point of sale is desirable. As an example, display package 10 is advantageously suited to the display of a musical instrument such as a drum of various kinds. FIG. 2 shows display package 10 containing a conga drum 30, by way of such an example, though it is to be understood that various articles of commerce, particularly musical instruments, may be advantageously contained and displayed within display package 10. The folded or otherwise assembled display package 10 has a rear panel 12 from which extend a top panel 14 and a bottom panel 16. Side panels 18 and 20 may be provided for bracing one or both of top and bottom panels 14 and 16 with respect to rear panel 12. Additionally, a central shelf 22, otherwise referred to as a "collar shelf" is also coupled to rear panel 12. While top and bottom panels 14 and 16 are substantially parallel and prevent motion of a displayed article from shifting in a direction perpendicular to the top and bottom panels, collar shelf 22 has an aperture 24 for retaining the displayed article with respect to lateral motion, i.e., motion having a component in a tangential direction to either of top and bottom panels 14 and 16.

Top panel 14 has an opening 26, either fully encircled by top panel 14 or extending to edge 28 of top panel 14, as shown. Opening 26 may have a circular shape, for example, or any other shape. Opening 26 allows access by a consumer to the top surface of the displayed article. In many cases such access is desirable, as when the displayed article is a percussion instrument such as a conga drum or a drum of another kind. In this case, the percussion head of the instrument is at least partially accessible for striking via opening 26, such as with the palm of the hand of the consumer.

A further opening 28 is provided in bottom panel 16 so that sound may be emitted from a sounding aperture (not shown) of an instrument. Opening 28 may have any specified shape, within the scope of the present invention, and is preferably round when package 10 is used for the display of a conga drum.

Referring now to FIG. 2, conga drum 30 is retained in display package 10 so that drumhead 32 is accessible to a consumer via top panel 14 and so that sound may be emitted via bottom panel 16 when the drumhead is struck.

Figure 3:
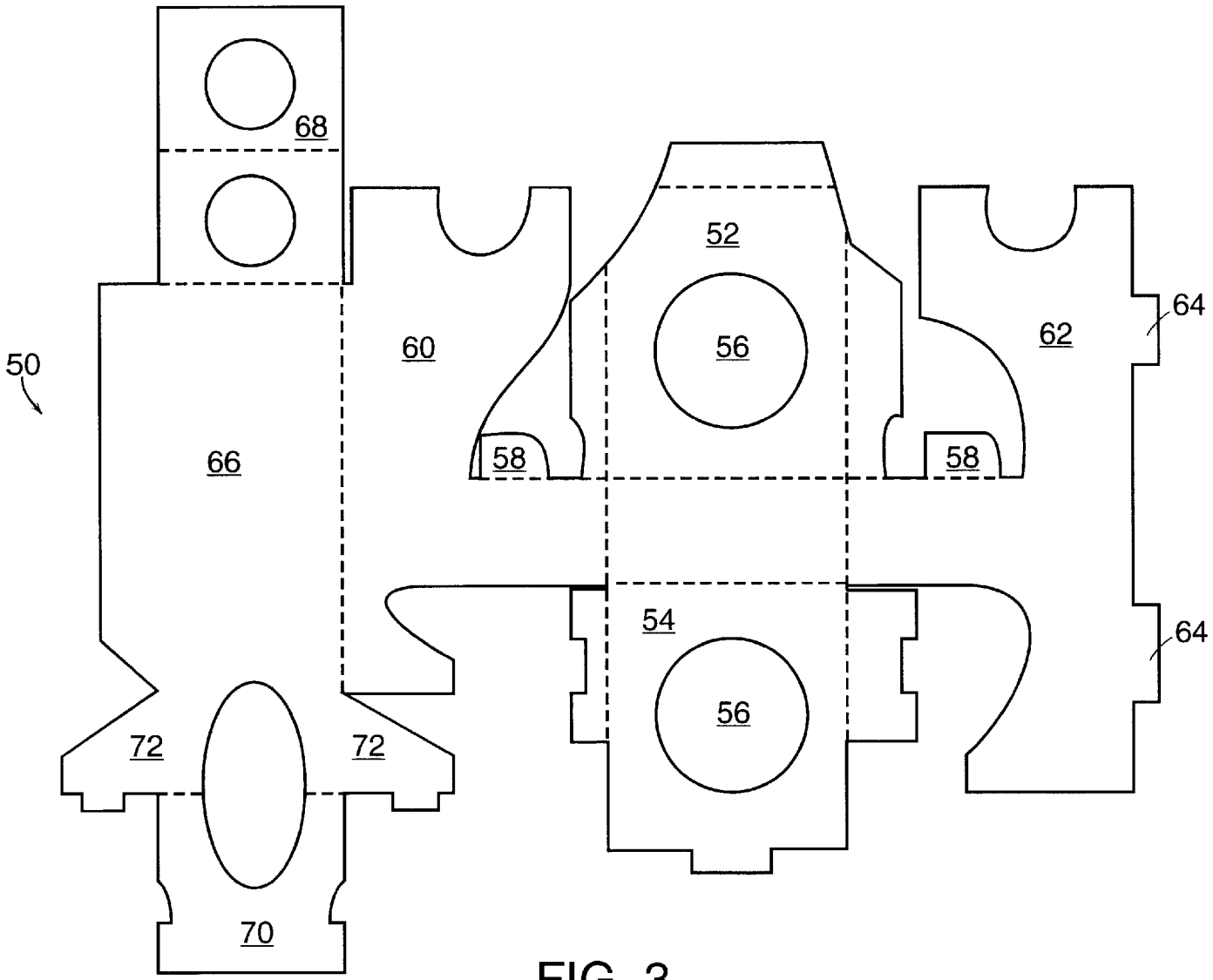
FIG. 3 is a view of a cut and scored blank for forming a display package according the embodiment of the present invention shown in FIGS. 1 and 2.

Referring to FIG. 3, the display package is preferably constructed from corrugated cardboard or other similar material assembled from blank 50 in sheet form into a three-dimensional shape by folding. However other materials may be employed within the scope of the present invention as described herein and as claimed in any appended claims. Portions 52 and 54 interfit with each other to form a collar shelf for retaining the displayed product in aperture 56. Tabs 58 engage the collar shelf from side sections 60 and 62. Tabs 64 engage side section 62 with back panel 66. Bottom panel 68 is formed by folding, while top panel 70 and side panels 72 are also folded together to form the ulterior portion of the display package.

In accordance with alternate embodiments of the invention, additional articles, including instrument accessories or other instruments, may be accomodated with the display packaging, such as by providing additional retaining openings within the collar shelf.

The described embodiments of the invention are intended to be merely exemplary and numerous variations and modifications will be apparent to those skilled in the art. All such variations are intended to be within the scope of the present invention as defined in the appended claims.

We claim:

1. A packaged musical instrument comprising:

a. a musical instrument having a percussion surface and a sounding aperture;

b. a top panel and a bottom panel, each of the top and bottom panels being coupled to a rear panel, the top and bottom panels being substantially parallel, the top and bottom panels being external panels of a package and the top and bottom panels engaging opposite ends of the musical instrument for preventing motion of the musical instrument in a direction perpendicular to the top and bottom panels;

c. a first opening in the top panel for consumer access to the percussion surface;

d. a second opening in the bottom panel for permitting emission of sound from the sounding aperture of the musical instrument; and e. a collar shelf coupled to the rear panel and disposed in a plane substantially parallel to the top panel, the collar shelf having an aperture for preventing motion of the musical instrument in any direction having a component tangential to the top panel.

2. A package according to claim 1, further including a side panel for bracing at least one of the top panel, the bottom panel, and the collar shelf with respect to the rear panel.

3. A package according to claim 1, wherein the first opening is substantially semicircular.

4. A package according to claim 2, wherein the second opening is substantially circular.

5. A method for displaying a musical instrument having a percussion surface and a sounding aperture at a point-of-sale, the method comprising:

a. retaining the musical instrument within a cavity of a display package, the display package having a top panel, a bottom panel, and a collar shelf, the top and bottom panels being external panels of the display package and the collar shelf having an aperture for preventing motion of the musical instrument in any direction having a component tangential to the top surface;

b. providing a first opening in the top panel for consumer access to the percussion surface of the musical instrument; and c. providing a second opening in the bottom panel for permitting emission of sound from the sounding aperture of the musical instrument.

* * * * *

UNITED STATES PATENT AND TRADEMARK OFFICE

CERTIFICATE OF CORRECTION

PATENT NO. : 6,059,103

DATED : May 9, 2000

INVENTOR(S) : Mark Izen and Brian Connolly

It is certified that error appears in the above-identified patent and that said Letters Patent are hereby corrected as shown below:

In the Claims:

Claim 2, Column 4, Line 1: replace, "A package according to claim 1..." with, "A packaged musical instrument according to claim 1..."

Claim 3, Column 4, Line 4: replace, "A package according to claim 1..." with, "A packaged musical instrument according to claim 1..."

Claim 4, Column 4, Line 6: replace, "A package according to claim 1..." with, "A packaged musical instrument according to claim 1..."

Signed and Sealed this

Third Day of April, 2001

*Attest:*

Nicholas P. Godici

NICHOLAS P. GODICI

*Attesting Officer*

*Acting Director of the United States Patent and Trademark Office*